United States Patent [19]

Kuriiwa

[11] Patent Number: 4,629,365

[45] Date of Patent: Dec. 16, 1986

[54] METHOD OF INSTALLING OFFSHORE PLATFORM

[75] Inventor: Tsuneaki Kuriiwa, Chiba, Japan

[73] Assignee: Sankyu Inc., Fukuoka, Japan

[21] Appl. No.: 748,680

[22] Filed: Jun. 25, 1985

[30] Foreign Application Priority Data

Sep. 11, 1984 [JP] Japan ..... 59-189898

[51] Int. Cl.[4] ..... E02B 17/00; E02D 5/74; E02D 25/00

[52] U.S. Cl. ..... 405/204; 405/227; 405/228

[58] Field of Search ..... 405/195, 203–206, 405/209, 210, 224, 227, 228; 114/265

[56] References Cited

U.S. PATENT DOCUMENTS

| | | | |
|---|---|---|---|
| Re. 30,825 | 12/1981 | Guy et al. | 405/204 |
| 3,064,437 | 11/1962 | Knapp | 405/206 |
| 3,093,972 | 6/1963 | Ward | 405/204 X |
| 3,680,644 | 8/1972 | Doughty | 405/228 X |
| 4,167,148 | 9/1979 | Fayren | 405/204 X |
| 4,252,469 | 2/1981 | Blight et al. | 405/204 |
| 4,362,439 | 12/1982 | Vaynkof | 405/228 |
| 4,556,004 | 12/1985 | Lamy et al. | 405/209 X |

FOREIGN PATENT DOCUMENTS

| | | | |
|---|---|---|---|
| 2373646 | 8/1978 | France | 405/204 |
| 2416306 | 10/1979 | France | 405/204 |
| 2476715 | 8/1981 | France | 405/206 |
| 21614 | 2/1982 | Japan | 405/204 |

*Primary Examiner*—Cornelius J. Husar
*Assistant Examiner*—Nancy J. Stodola
*Attorney, Agent, or Firm*—Koda and Androlia

[57] ABSTRACT

A method of installing an offshore platform. The superstructure is assembled and completed in advance in a fabrication yard. The superstructure with a floating body attached thereto is transported to the area of the sea where a jacket of the platform has been erected by towing the superstructure while floating on the sea. It is made to sink by pouring sea water into the floating body and installed on the top portion of the jacket which is situated under the sea level. An extension is attached to the jacket in advance such as to project above the sea level during the piling operation and thereafter it is removed such that the top portion of the jacket is brought to a position below the sea level.

1 Claim, 21 Drawing Figures

METHOD OF INSTALLING OFFSHORE PLATFORM

BACKGROUND OF THE INVENTION

1. Field of the Invention

This invention relates to a method of installing an offshore platform, and more particularly, to a method of installing a superstructure of an offshore platform on the top portion of a jacket which is fixed to the seabed.

2. Description of the Related Art

The conventional method of installing an offshore platform will be explained with reference to FIGS. 1 to 8. An offshore platform is composed of a jacket which is secured to the seabed and a superstructure which is supported by a support frame on the jacket. The jacket 1, having its own buoyancy, is first transported to a position for fixing the jacket 1 by a floating crank 3 (FIG. 1) and after positioning, it is made to sink to the seabed by pouring water into the steel pipes 31 which constitute the frame of the jacket (FIG. 2). This jacket 1 is tall enough to protrude above the sea level at its top portion. Once the bottom portion of the jacket 1 reaches the seabed, it is fixed by a pile 2 driven from above the sea level, as is shown in FIG. 2. A platform support frame 3 for supporting the superstructure of the platform is next installed, as is shown in FIG. 3. This superstructure of the platform is divided into several modules 4, which are successively installed by a floating crane 33 on the support frame 3, as is shown in FIGS. 4 and 5. At the same time as the installation of the modules 4 hook-up work is started. "Hook-up work" means pipework, wiring work, work of fitting apparatus sent separately from the above-described units, and so on. Therefore an accommodation module 5 (with a helicopter deck) is installed as is shown in FIG. 6, and a drilling apparatus 6 and the like are installed, as is shown in FIG. 7. After the completion of the above-described mechanical assembly of the units, commissioning which consists of trials and test runs is conducted to confirm effective function of the facilities, as is shown in FIG. 8, and a proper run is thus made possible.

Since this series of processes is conducted at sea, the working circumstances are very severe, and entailing many risks and requiring much time and expense. In addition, many workers are forced to live at sea for a long time under bad conditions. In order to improve these problems, the tendency is to make modules larger in size to reduce the number of units of the superstructure of a platform.

The location for such platform are increasingly selected in deep water areas and since the price of a jacket for a deep water platform advances in geometric progression in proportion to the depth of the sea area, a demand has arisen to concentrate facilities, which could separately arranged in several platforms according to their functions in shallow water, into one platform. Consequently a platform is apt to be lofty and extremely large with various facilities, and hence there is an increasing tendency to employ larger and larger modules.

However, there is a limit to the feasible size of a floating crane from the physical and economical point of view, and, therefore, to the size of a module.

SUMMARY OF THE INVENTION

Acordingly it is an object of the invention to provide a method of installing an offshore platform without use of a large-sized floating crane after piling, and in which large-size modules are assembled as one superstructure of the platform in a fabrication yard and is transported from the fabrication yard directly to an area of the sea where a jacket has been fixed for installation on that jacket.

A method of installing an offshore platform according to the invention is a method essentially consisting of the steps of forming a superstructure with a floating body, transporting the superstructure to an area of the sea where it is to be installed, sinking the superstructure by pouring the sea water into the floating body, and installing it on the top portion of a jacket which is located at a predetermined depth below the sea level.

In other words, the method comprises the steps, (1) completing in a fabrication yard a superstructure of an offshore platform having a floating body, (2) transporting the superstructure, to an area of the sea where a jacket has been erected, by towing the superstructure while floating on the sea, or alternatively by loading it on a float on/off loading type cargo boat after floating it on the sea, (3) sinking the superstructure by pouring sea water into the floating body and installing the superstructure on the top portion of the jacket below the sea.

The floating body may either be an integral part of the offshore platform or may be removable from the offshore platform after installation. If it is an integral part of the offshore platform, it is able after installation to reduce the supporting load of the jacket by virtue of its own buoyancy of the floating body and the interior of the floating body can be used for storing supplies.

The top portion of a jacket used for this invention should be below the surface of the sea. In piling this kind of jacket, rather than directly fixing the jacket of a height which will enable it to be located below the sea level, it is preferable that proper extension of a length sufficient to project above the sea level is first attached to the jacket and after the ordinary piling operation this extension with pile is cut off, whereby the top portion is brought to a position below the sea level.

According to the invention, even if a platform is lofty and large in size, the superstructure of the platform can be assembled and completed as one body with necessary apparatus in a "fully furnished fabrication yard". Further, since assembly work of the superstructure can be completed in the yard as described above, improvements in the quality of a platform can be achieved. Test runs of the mechanisms of the platform may also be conducted in the yard, which shortens the length of time spent on construction work at sea. In addition, the method according to the invention dispenses with a large-sized floating crane for installing modules of the platform unlike the conventional method. Accordingly, reduction of the total cost, and period of construction, and decrease in the risks involved during construction can be achieved, thus making it possible for the area of the sea where construction of a platform is feasible to be enlarged.

The above and other objects, features and advantages of the present invention will become clear from the following description of the preferred embodiment thereof, taken in conjunction with the accompanying drawings.

DESCRIPTION OF THE PREFERRED EMBODIMENT

A first embodiment of the invention will be explained with reference to FIGS. 9 to 18. In this embodiment a part of a floating body is removable.

Figure 2:
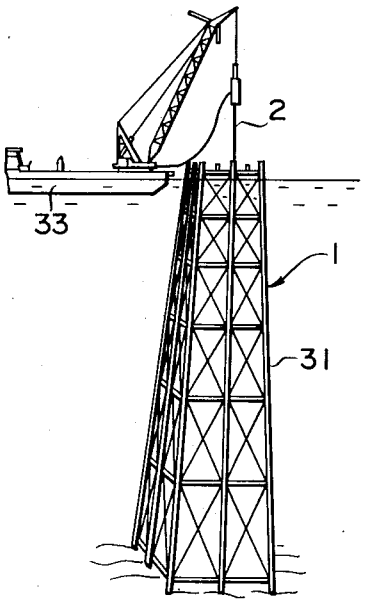
FIG. 2 PRIOR ART
FIGS. 1 to 8 show the processes of the conventional method of installing a platform.
Figure 1:
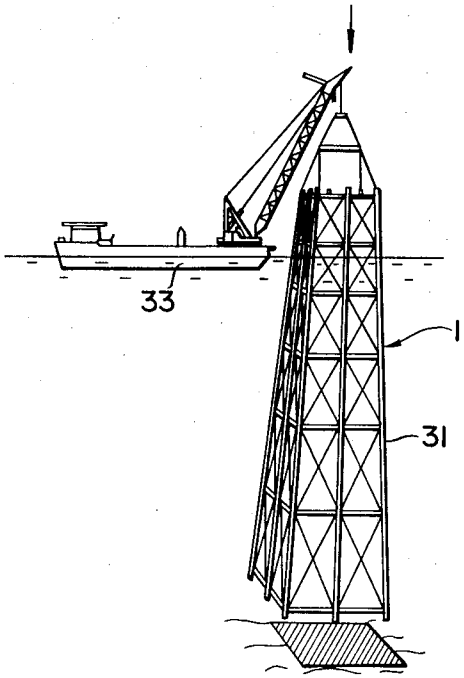
FIG. 1 PRIOR ART
Figure 5:
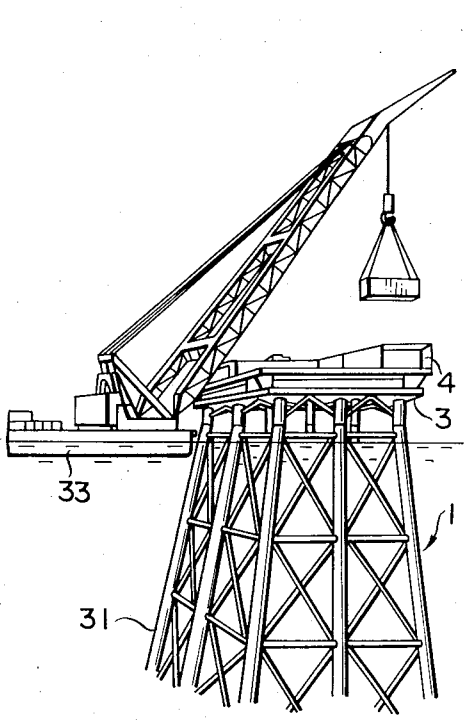
FIG. 5 PRIOR ART
Figure 4:
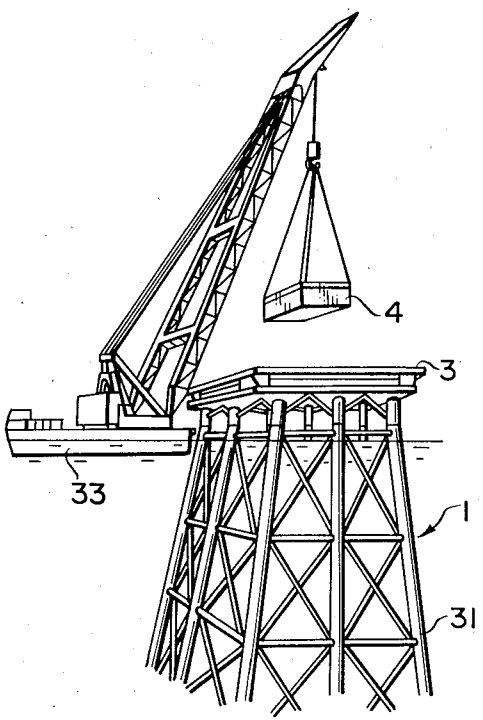
FIG. 4 PRIOR ART
Figure 3:
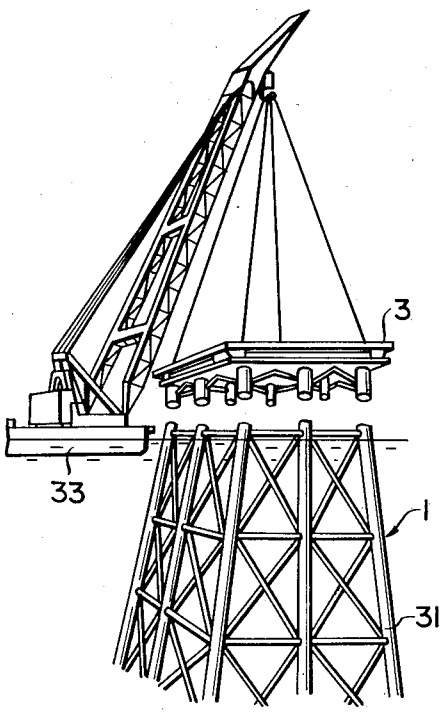
FIG. 3 PRIOR ART
Figure 8:
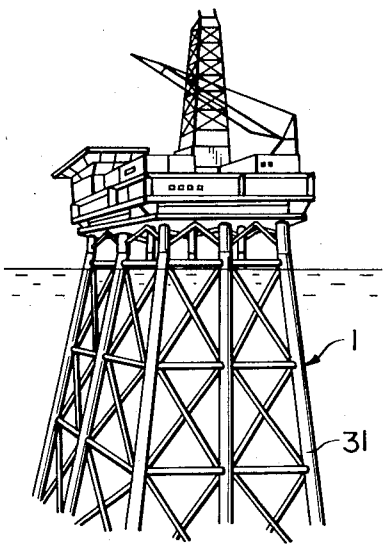
FIG. 8 PRIOR ART
Figure 7:
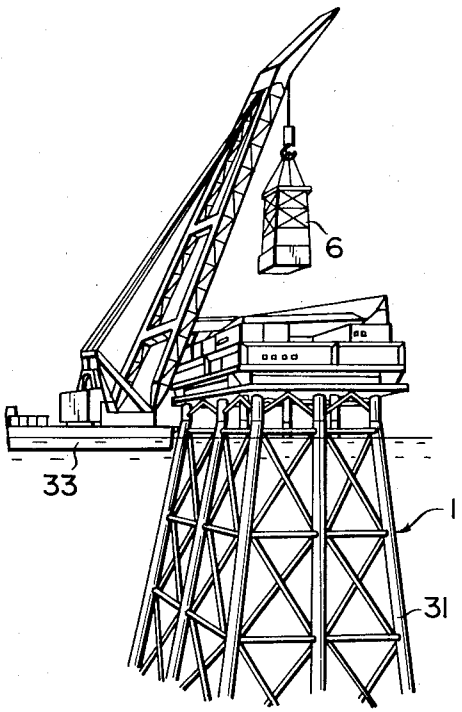
FIG. 7 PRIOR ART
Figure 6:
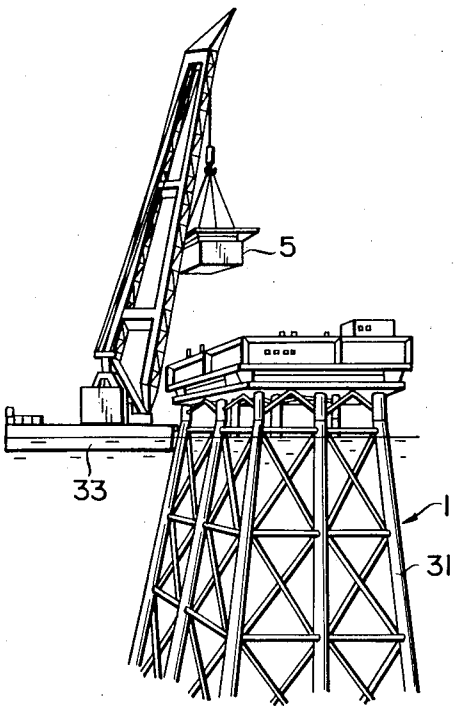
FIG. 6 PRIOR ART
Figure 11:
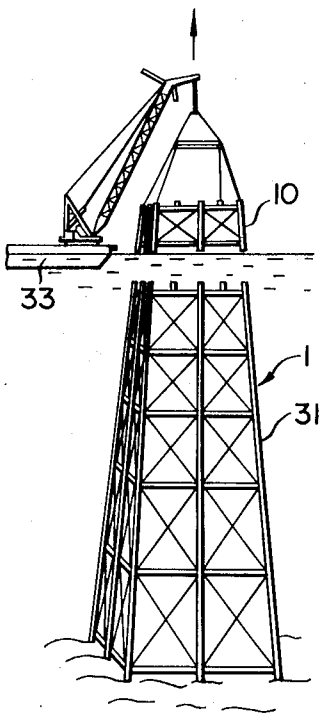
FIGS. 9 to 16 show the processes of an embodiment of a method of installing an offshore platform according to the invention.
Figure 10:
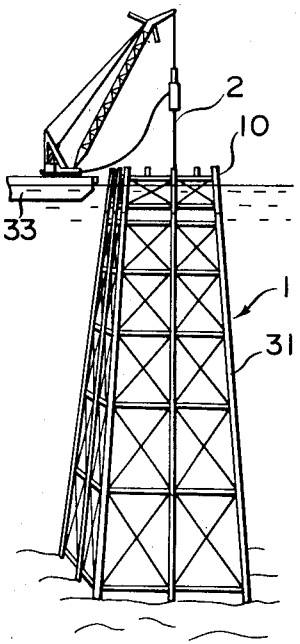
Figure 9:
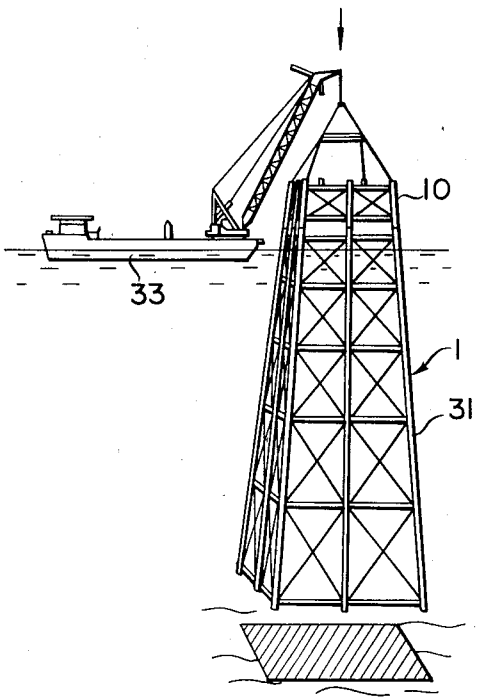
Figure 13:
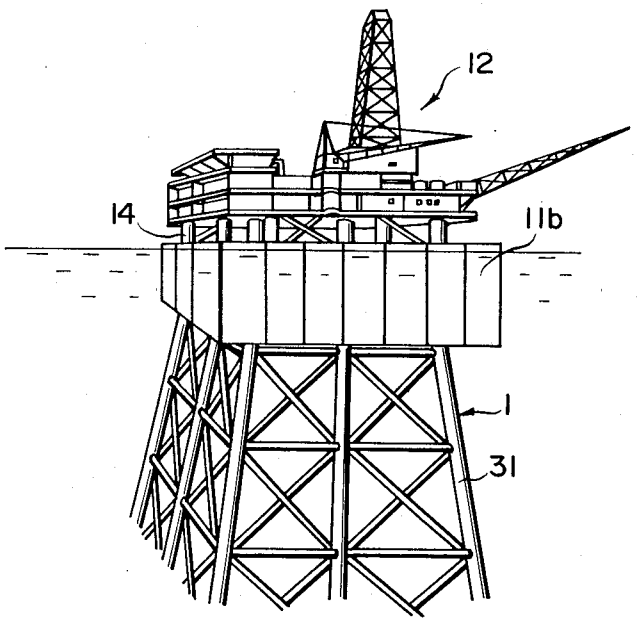
Figure 12:
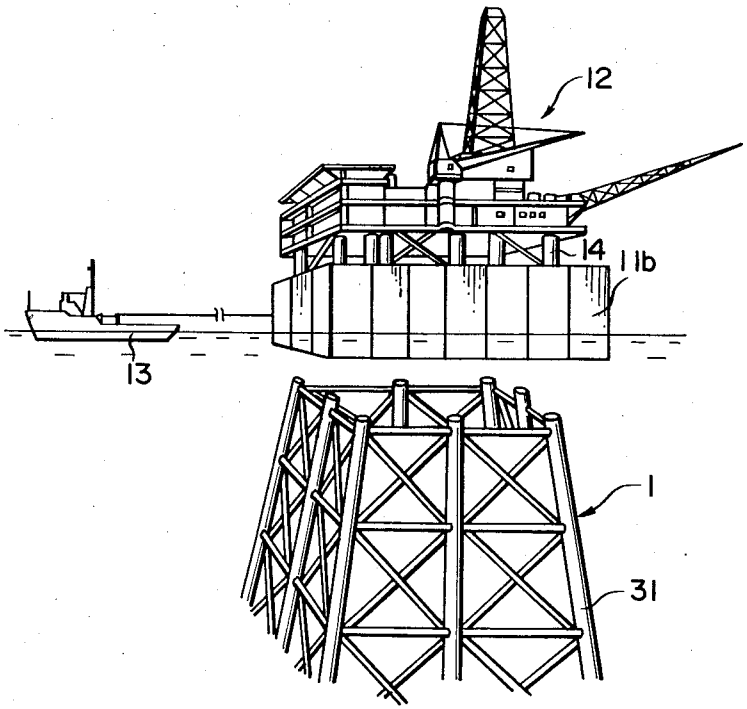
Figure 15:
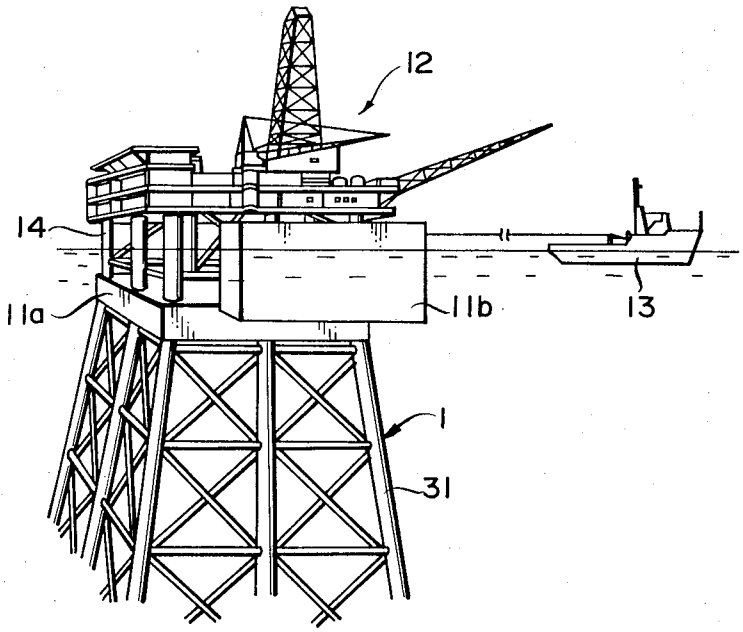
Figure 14:
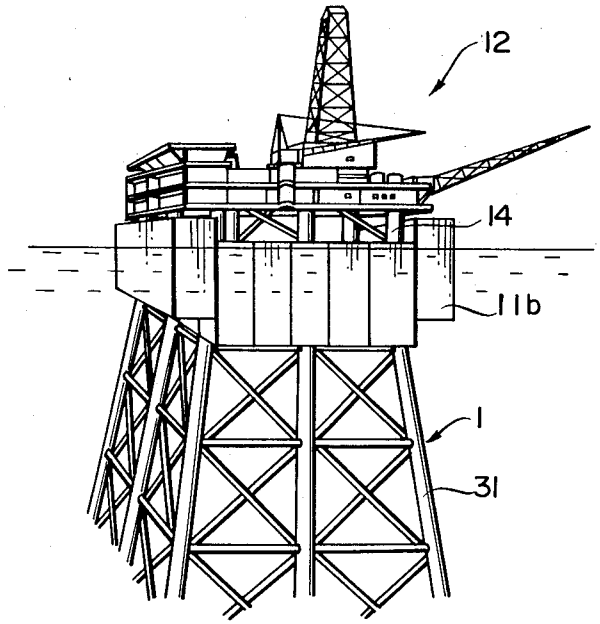
Figure 17:
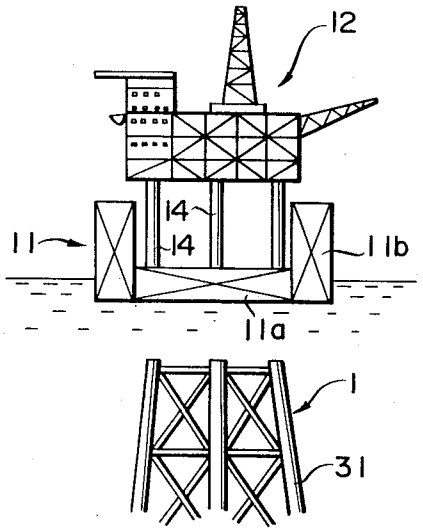
FIG. 17 is a cross sectional view of the super-structure of the platform shown in FIG. 12.
Figure 16:
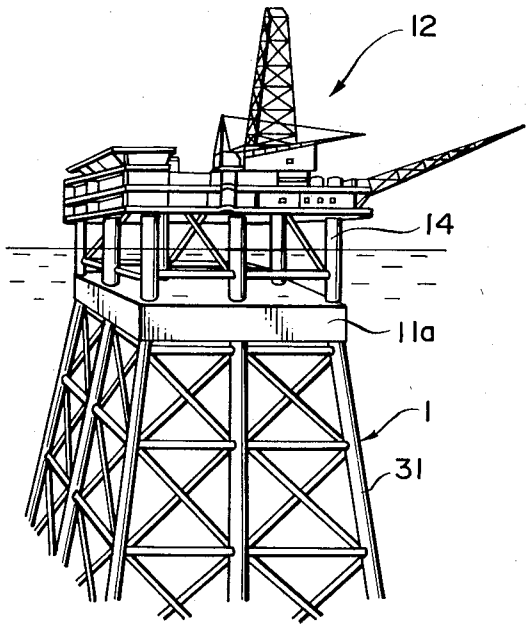
Figure 18:
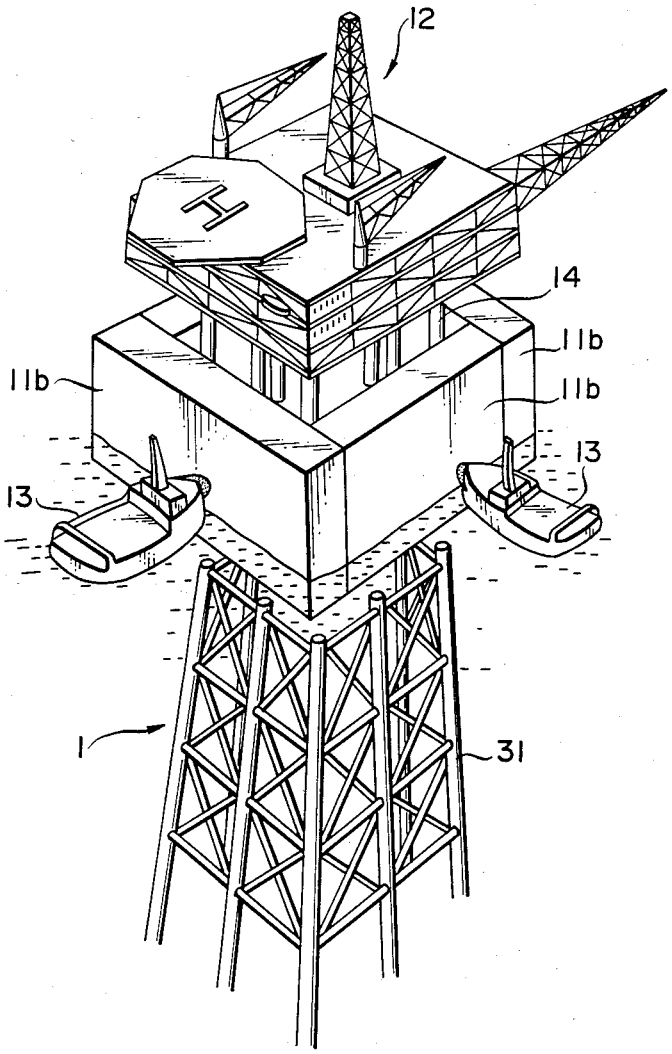
FIG. 18 is an enlarged perspective view of the superstructure shown in FIG. 17.

Referring to FIG. 9, the jacket 1 is transported to the position where it is to be erected by the floating crane 33, and after positioning, it is made to sink to the seabed by pouring water into steel pipes 31 forming frames of the jacket 1. The pile 2 shown in FIG. 10 is next driven from above the sea level so as to fix the bottom portion of the jacket 1 to the seabed. The jacket 1 has a removable extension 10 which projects above the surface of the sea during the piling operation. After the jacket 1 is fixed, the extension 10 is cut off, whereby the top portion of the jacket 1 is brought below the sea level, as is shown in FIG. 11. Referring to FIG. 12, the superstructure 12 of the platform is towed by a tug boat 13 and transported to a position right over the jacket 1. FIGS. 17 and 18 show the cross sectional view and perspective view, respectively of FIG. 12. A floating body 11 consists of a box-shaped bottom floating body 11*a* and box-shaped side floating bodies 11*b*. The bottom floating body 11*a* constitutes a part of the platform after installation thereof and not only reduces the supporting load of the jacket 1 by virture of its own buoyancy but also serves as a storage facility for the supplies. FIG. 13 shows the state in which sea water is poured into the floating body 11 so as to sink the superstructure 12 of the platform and install it on the top portion of the jacket 1 which is situated below the surface of the sea. As is shown in FIG. 14, the water is next drained from the side floating bodies 11*b* which are attached to the superstructure 12 of the platform and they are removed from the superstructure 12. The removed side floating bodies 11*b* are towed by the tug boat 13 to the off-construction site, as is shown in FIG. 15. FIG. 16 shows the completed state of the method of installing the platform. At this time, unlike the conventional method, hook-up work or test runs are only minimally necessary, which fact, together with the fact that it is unnecessary to divide the superstructure into modules, makes it possible for the period of construction to be shortened still further.

In this embodiment, the offshore platform having the floating body after installation has the configuration of, as it were, a semi-submersible type construction (semi-submersible type drilling rig, etc.) since the superstructure 12 is constructed on several columnar structures 14 which are erected on the box-shaped bottom floating body 11*a*. It is necessary for the bottom floating body 11*a* to be situated at an appropriate depth below the sea level where it will be away from the influence of wave action and also for the superstructure 12 to be high enough to prevent waves from directly hitting the bottom surface of the superstructure 12.

Figure 19:
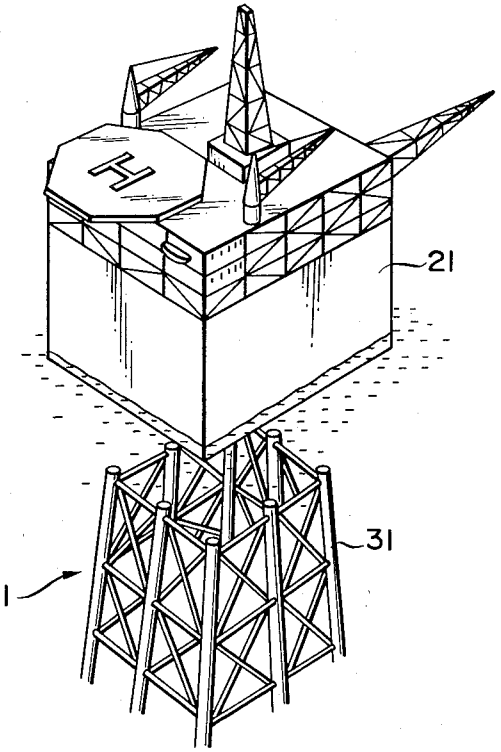

Though the superstructure 12 of the above-described embodiment has the columnar structures 14 for the purpose of avoiding the influence of wave action, in the case of a platform provided in an area of the sea where there is little influence from wave action, it is possible to make the box-shaped bottom floating body integrally with the upper structure into one box 21, as is shown in FIG. 19.

In the first embodiment, the jacket has the extension 10 attached thereto and after the piling operation the extension is cut off, whereby the top portion is brought to a position below the surface of the sea. In the other embodiment, however, it is not always necessary to have this extension added, and a special positioning method and a special piling device may be utilized in accordance with the prior art.

Figure 20:
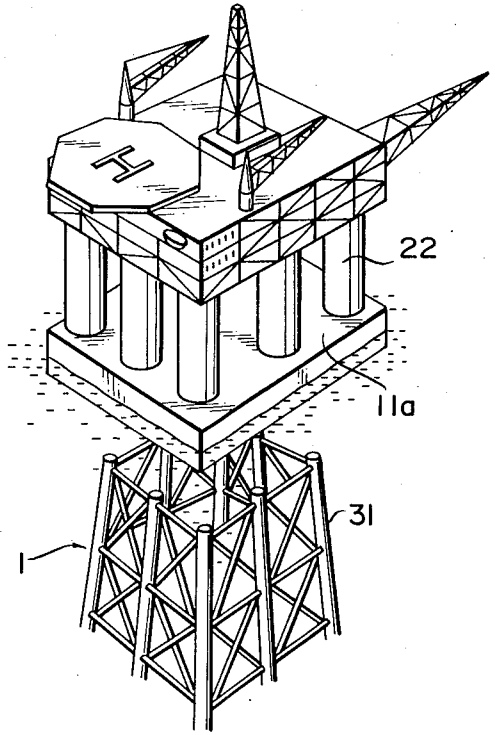
FIGS. 19 to 21 show other embodiments of the superstructure of the platform and respectively correspond to FIG. 18 showing the first embodiment.

Though the side floating bodies in the first embodiment are box-shaped, the columnar constructions 22 may also serve as floating bodies, as shown in FIG. 20. The floating bodies in this case are not removable from the platform.

Figure 21:
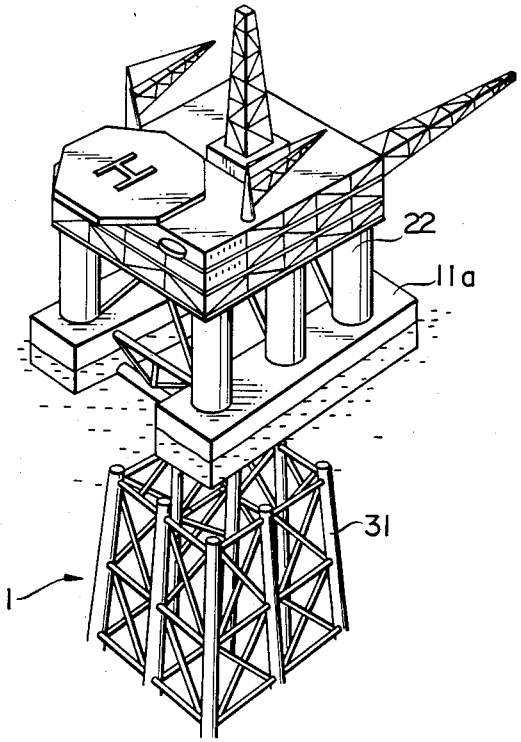

Furthermore, the bottom floating body shown in FIG. 20 may have a configuration like a semi-submersible type drilling rig, as is the case with the floating body 11*a* shown in FIG. 21.

When a floating body constitutes a part of a platform and is unremovable as in the above-described embodiments, the load applied to the jacket 1 is reduced by virtue of the buoyancy of the floating body. In addition the interior of the floating body can be used as a place for storing supplies.

While there has been described what are at present considered to be preferred embodiments of the invention, it will be understood that various modifications may be made therein, and it is intended that the appended claims cover all such modifications as fall within the true spirit and scope of the invention.

What is claimed is:

1. In a method of installing a superstructure of an offshore platform on the top portion of a jacket with the top portion positioned at a predetermined depth below the sea level, said superstructure having a floating body for floating on the sea and being completed in a fabrication yard and transported to the area of the sea where said jacket has been erected and then sunk by pouring the sea water into said floating body to be installed on said jacket, a method of fixing said jacket to the seabed comprising the steps of:

attaching a removable extension to the top of said jacket so that said jacket has a height sufficient to project above the sea level;

erecting and positioning said jacket at a desired position of the seabed in such a manner that said extension projects above the sea level;

piling said jacket by driving piles from above the sea level; and cutting off said extension after piling said jacket so that the top portion of said jacket is brought to a position below the sea level.

* * * * *